United States Patent [19]

Pan

[11] 4,421,284

[45] Dec. 20, 1983

[54] REELING OF CABLE

[75] Inventor: Ali Pan, Storrington, Canada

[73] Assignee: Northern Telecom Limited, Montreal, Canada

[21] Appl. No.: 294,405

[22] Filed: Aug. 19, 1981

[51] Int. Cl.[3] ..... B65H 54/28

[52] U.S. Cl. ..... 242/158 R

[58] Field of Search ..... 242/158 R, 158 F, 158.2, 242/158.4 R, 158.4 A, 157.1, 25 R, 7.14, 7.15, 7.16

[56] References Cited

U.S. PATENT DOCUMENTS

| | | | |
|---|---|---|---|
| 3,319,070 | 5/1967 | Schneider | 242/158 R X |
| 3,544,035 | 12/1970 | Woolever | 242/158 R |
| 3,951,355 | 4/1976 | Morioka et al. | 242/158 R |
| 4,143,834 | 3/1979 | Hara et al. | 242/158 R |
| 4,150,801 | 4/1979 | Ikegami et al. | 242/158 R |

*Primary Examiner*—Stanley N. Gilreath
*Attorney, Agent, or Firm*—R. J. Austin

[57] ABSTRACT

Cable laying apparatus with a cable guide mechanism having a guide roller and means to apply a force downwardly through the cable feed path at an inclined angle opposite to the direction of lay of the cable. In one construction, a cable guide roller is inclined to direct its laying surface opposite to its direction of transverse and a means is employed to apply a downward force to the roller. In another construction, two opposed rollers are used and a biasing means causes the rollers to trail behind the lay direction. In this construction, the guide mechanism is mounted by a universal connection and employs means to apply a downward pivoting force at the connection which is inclined to the vertical also in a trailing sense relative to the direction of cable lay.

25 Claims, 17 Drawing Figures

14
148
146
150
120
12

156
14
154
120
152
12

14
120
154
152
156
12

124
126
120
14
122
120
12
128
130
132
140
134
136

REELING OF CABLE

This invention relates to the reeling of cable onto a drum.

In conventional methods of reeling cable onto a drum, the cable is fed onto the drum surface under a guide roller which is intended to direct the cable so that it lies in adjacent windings upon the drum, one layer of windings after another. In such apparatus, the drum and guide are relatively traversed axially of the drum so as to reel the cable in adjacent windings in each layer. It is found in practice that if the cable tends to be twisted, this sometimes makes it impossible for the cable to be laid strictly in side-by-side and contacting windings.

The laying of twisted cable or the use of cable guide mechanisms which have lack of control over the cable position as it is reeled, causes gaps to be formed between windings or the climbing of windings over previous windings in the same layer. This, of course, affects the positions of windings in succeeding layers thus resulting in a badly reeled cable.

Because it is extremely difficult to lay the windings in a desirably strict manner, complex cable laying apparatus has been devised which include elaborately controlled guiding mechanisms which accurately control the winding positions.

According to one aspect of the present invention, a cable laying apparatus comprises a mounting for a reel in a reel mounting position, means to rotate the mounted reel about an axis, a cable guide mechanism, the guide mechanism comprising guide roller means carried upon a support on one side of a pass line for cable as it is wound onto the reel, and a traversing means to relatively traverse the guide roller means and the reel mounting in one direction and then in the opposite direction, force applying means to apply a force through the guide roller means and through the feed path, said force having one component opposite to the direction of relative traverse of the guide roller means and another component inwardly towards said axis so as to urge cable as it wound onto the reel both inwardly of the reel and against a previous winding, and means operable at the end of each traverse to change the direction of traverse and the direction of said force to correspond to the change in direction of traverse.

In one preferred arrangement, the guide roller means comprises a cable laying guide roller which is inclined to the direction of traverse of the roller with part of the roller facing the feed path being a trailing part with regard to the relative direction of traverse, and means are provided, operable at the end of traverse in each direction to change the angle of inclination of the guide roller to one opposite to the relative direction of traverse of the guide roller in the opposite direction.

In another preferred arrangement, the guide roller means comprises two guide rollers opposed to one another across the feed path, the rollers mounted upon an arm to closely hold the cable as it is fed through the rollers and onto the reel. Means is provided for biasing the rollers in a trailing sense during each traverse whereby the rollers pull the cable directly against the previous winding upon the reel.

Embodiments of the invention will now be described by way of example, with reference to the accompanying drawings, in which.

In a first embodiment shown in FIGS. 1–6, a cable reeling apparatus comprises a conventional reel mounting device (not shown) for locating a cable reel 10 in a reel mounting position. It also includes a conventional traversing means to move the reel axially from one limiting position to another to enable cable 12 to be laid in side-by-side windings from end to end of the reel laying surface defined between end flanges 14 (one only being shown).

Figure 1:
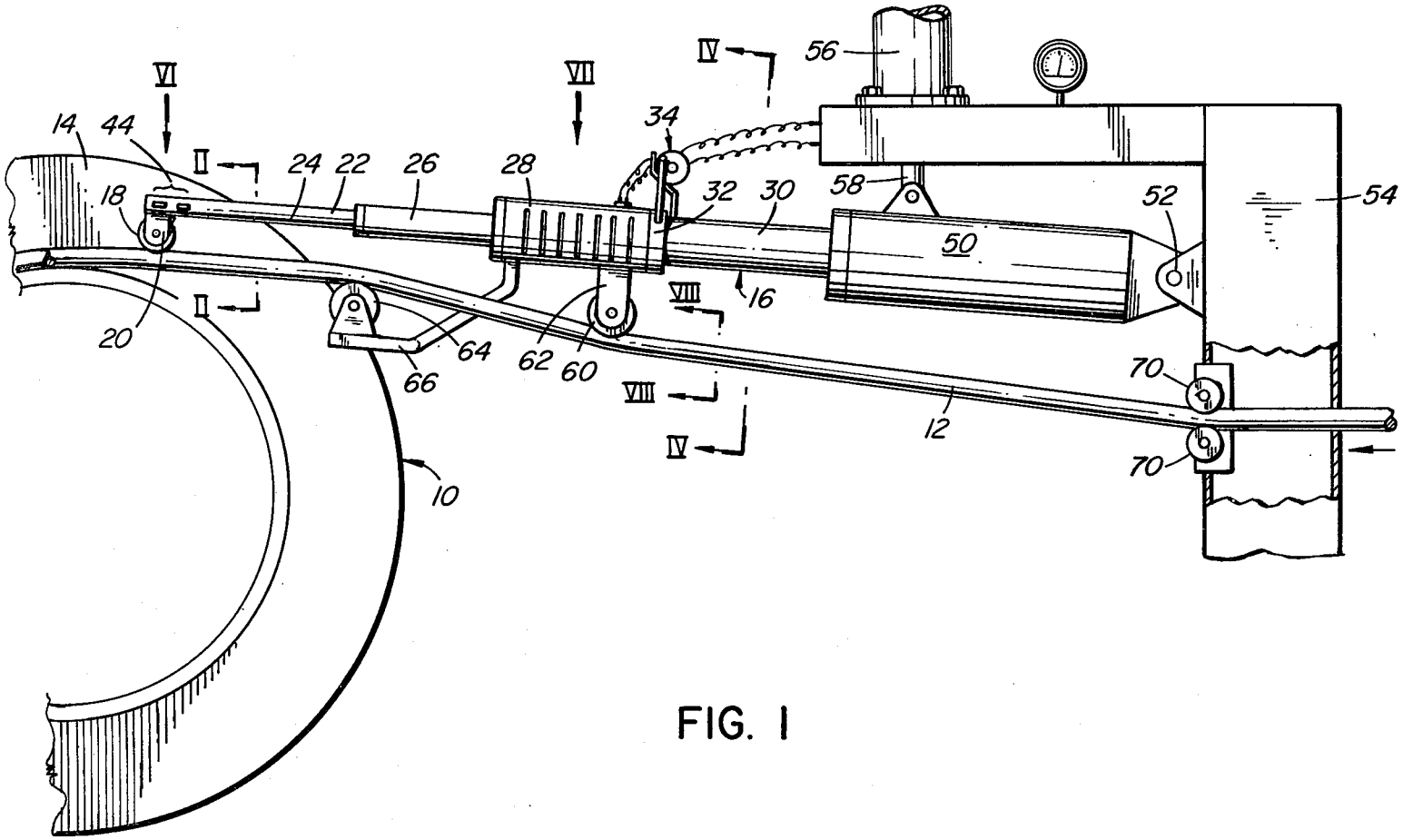
FIG. 1 is a side elevational view of a cable laying apparatus according to a first embodiment with a reel partly wound with cable.
Figure 2:
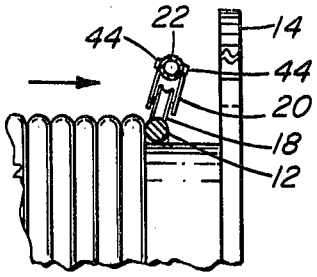
FIG. 2 is a cross-sectional view of part of the apparatus taken along line II—II in FIG. 1.

The apparatus also includes a cable guide mechanism which is inventively different from those previously known. This guide mechanism 16 comprises a guide roller means including a cable laying guide roller 18 which is rotatably mounted upon a bracket 20 secured to the free end of a mounting arm 22 which is provided by two teliscopically fitting shaft portions 24 and 26 to enable the position of the guide roller 18 to be adjusted relative to the peripheral surface of the reel 10. The mounting arm 22 is held at the end remote from the guide roller within a mounting 28 which also houses an electrical vibrator of known construction. The electrical vibrator 28 and the arm 22 are held together so as to be oscillatable upon a primary mounting arm 30 by a rotatable coupling 32. Because the arm 22 is oscillatable and therefore positionable in angular positions upon the arm 30 the guide roller may be inclined in any desired position. In fact the guide roller is inclined in predetermined positions dependent upon the relative direction of traverse of the reel and the guide roller. As shown by FIG. 2, for instance, the guide roller 18 is inclined relative to the traverse direction so that a part of the guide roller which faces towards the feed path trails the rest of the roller during the traverse. For instance, as shown by FIG. 2 in which the reel is moving from right to left with the effect that the guide roller is moving from left to right relative to the reel, the lower part of the roller which contacts the cable as it is wound onto the reel trails the remainder of the roller. Similarly, with regard to FIG. 3 with the direction of traverse opposite to that in FIG. 2, the guide roller 18 is inclined in the opposite sense to that of FIG. 2.

Figure 3:
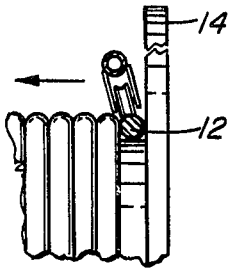
FIG. 3 is a view similar to FIG. 2 showing the apparatus in a different position during winding.
Figure 5:
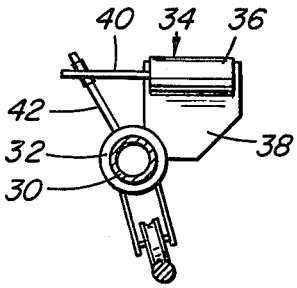
FIG. 5 is a cross-sectional view similar to FIG. 4 showing the parts of the apparatus in different relative positions.
Figure 4:
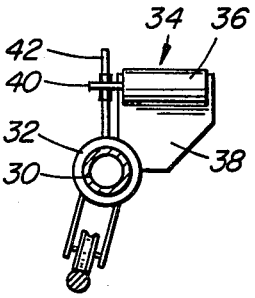
FIG. 4 is a cross-sectional view of part of the apparatus taken along lines IV—IV in FIG. 1.

Means is provided operable at the end of traverse in each direction to change the angle of inclination of the guide roller 18 between the two positions shown by FIGS. 2 and 3. This means comprises a position control device 34 which includes a solenoid operated air pressure cylinder (see FIGS. 4 and 5). The air cylinder 36 is mounted upon a bracket 38 extending outwardly from the arm 30 and has its piston rod 40 pivotally connected at its free end to a radial arm 42 extending radially outwardly from and secured to the rotatable coupling 32. The inclination of the guide roller 18 may be at any desired angle to place a force upon the cable by contact with the roller to lay cable in a correct wound position upon the reel, it has been found that a relatively small angle will suffice for this and in this embodiment an angle of 15° inclined to each side of the vertical position is sufficient for the purposes of the invention. Hence, the air pressure cylinder 36 need only operate so as to move the arm 42 around an angle of 30° with respect to the centre of the arm 22.

Figure 6:
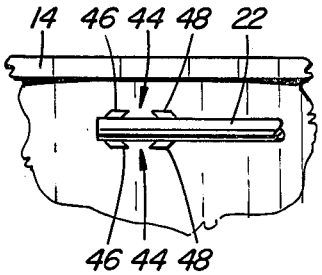
FIG. 6 is a view taken in the direction of arrow VI—VI in FIG. 1, showing details of the apparatus.

A switch means 44 is provided upon the end of the arm 22 in a position adjacent to the guide roller 18 for the purpose of operating the air pressure cylinder electrically to cause the roller to tilt from one inclined position to the other at the end of each traverse. It is intended that the guide roller during its traverse is located between the flanges 14 of the reel and thus it is convenient to use the distance of the arm 22 from the flanges to indicate the appropriate time to change the angle of inclination of the guide roller. While the switch 44 may be any type of switch appropriate for the purpose, for instance a limit switch having a physically operable switching arm when contacted by each flange, the switch is, in fact, an optical switch. As shown by FIG. 6, at each side of the arm 22, the switch comprises a light source 46 and a light detector 48 which detects light emitted by the source 46 when this is reflected back at the appropriate angle from a surface positioned a specific distance from the arm 22. Upon light being detected by the detector 48, the solenoid, to operate the cylinder 36, is electrically actuated to change the angle of inclination of the guide roller 18 as previously discussed. A suitable type of optical switch for this purpose is one known as "Opcon". With this switch, the position of the arm from each flange 14 may be judged precisely and, at this position, the guide roller 18 is changed in its angle of inclination as the direction of traverse changes to the opposite direction. The optical switch 44 also causes a change in direction of the traverse itself by being electrically connected to the traversing means. Hence the direction of traverse and the direction of inclination of the guide roller are changed simultaneously.

The primary mounting arm 30 itself forms a piston rod of a fluid operated cylinder 50 which is pivotally connected at position 52 to a frame 54 for vertical pivotting movement of the arm 30 and thus arm 22.

Means is provided to apply force through the guide roller 18 and through the feed path. This force is applied by a fluid operated cylinder 56 which is mounted above the cylinder 50 and is secured to the frame 54. The piston rod 58 of the cylinder 56 is pivotally connected to the free end of the cylinder 50. The cylinder 56 is a constant pressure cylinder which thus provides a constant downward pressure on the cylinder 50 tending to urge the arms 22 and 30 downwardly while allowing the arms to rise after the formation of each layer of winding upon the reel and in readiness for the next succeeding layer of windings which lie on top. As may be seen, although the forces applied by cylinder 56 is downwardly, because of the angle of inclination of the guide roller 18 as described, the force which the guide roller 18 applies to the cable as it is being laid into position upon the reel is at the angle of inclination. Thus the force applied to the cable has a downward component, i.e. towards the axis of the reel, and it also has a component opposite to the direction of relative traverse of the guide roller and the reel.

Figure 8:
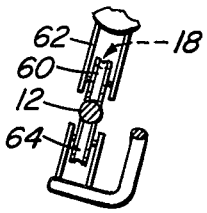
FIG. 8 is a cross-sectional view along line VIII—VIII in FIG. 1 showing the relative position of guide rollers.
Figure 7:
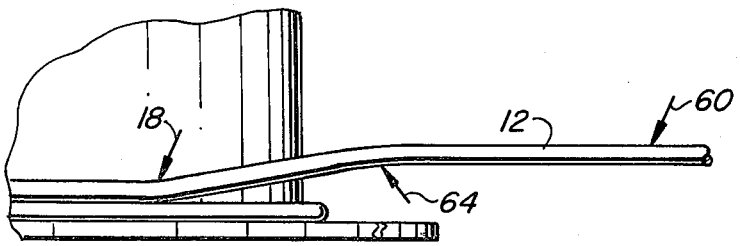
FIG. 7 is a view taken in the direction of arrow VII—VII in FIG. 1 showing the feed path of cable onto the reel.

Two other guide rollers are included within the guide roller means. These guide rollers consist of guide roller 60, mounted on an extension 62 from the vibrator 28, and a guide roller 64 located intermediate the guide rollers 18 and 60 and mounted on an extension 66 upon the vibrator 28. As may be seen from FIG. 8, the roller 64 is directly opposed across the feed path from rollers 18 and 60 and also has the effect of deflecting the cable away from a straight line as can be seen from FIGS. 1 and 7. The effect of this deflection is to displace the cable feed path as it moves around the roller 64 away from the preceding windings laid upon the reel. The roller 18 thus moves the cable from its displaced position around the guide roller 64 and brings it in at an angle to the preceding winding whereby the cable does not contact the preceding winding until it is actually being laid into position. Hence the cable is prevented from contacting the preceding winding as it is wound into position. Thus any effect caused by frictional contact with the preceding winding to displace the cable from its true laid position is avoided. FIG. 7 illustrates in exaggerate shape of the path of the cable as it moves past the three guide rollers, the arrows indicating the action of the rollers upon the cable. As can be seen, the cable does not contact the last winding upon the reel until it acutally moves around the guide roller 18.

During operation of the apparatus, cable 12 is fed through feed rollers 70 held upon the frame 54, beneath the guide roller 60, over guide roller 64 and under the guide roller 18 and onto the reel. The position of guide roller 18 is changed as is necessary, by operation of the cylinders 56 and 50 to locate it in the best possible position for laying windings next to each other upon the reel. As the reel is traversed in either direction, a layer of windings is laid upon the reel with the arm 22 disposed in an angular position by the cylinder 36 so that the guide roller 18 is appropriately inclined at its angle of 15° to the vertical with the lower part of the roller facing away from the direction of traverse. This is as shown in FIGS. 2 and 3. The operation of the roller 64 to hold the cable away from the previous winding has already been discussed. The action of the inclined roller 18 is such that it applies the load imposed by cylinder 56 at the inclined angle of the roller whereby the cable is urged downwardly and slightly in a direction away from the direction of traverse. This causes the cable to nest intimately against the preceding winding and also directly upon a winding or between windings of the previous layer of windings. The frictional contact with the preceding winding of the same layer, which could be troublesome in resisting the location of the cable upon the reel, is reduced to an insignificant factor by the use of the vibrator 28. The vibrator vibrates the arm 22 and guide roller 18 so as to overcome this frictional gripping tendency and the cable is laid correctly in position. Towards the end of each traverse, as shown for instance by FIG. 2, the arm 22 and thus the switch 44 approaches towards a flange 14. Upon the flange being disposed in a predetermined position away from the arm, the detector of the switch detects light being deflected by the flange from the source and immediately actuates the air pressure cylinder 36 to change the angle of inclination of the guide roller. The cylinder 36 is equipped with a metering valve which adjusts the speed of its operation so that the angle of inclination of the roller is changed at a speed such that it enables the final winding to be located in position against the flange before the roller assumes its new position of inclination as indicated by FIG. 3. At this stage, the traversing means is operated to cause the drum to move in the opposite direction to lay a succeeding layer of windings upon the drum. To enable the succeeding layer to be located in position, the arm is automatically raised by contacting the guide roller upon the previous layer of windings and against the action of the cylinder 56.

As may be seen from the first embodiment, a simply constructed apparatus may be provided for laying cable correctly and accurately upon a reel while avoiding any tendency for gaps to be produced between adjacent windings or for adjacent windings to climb one upon the other. Hence a perfectly wound and reeled cable may be produced without resorting to complex machinery which operates by the accurate location of guiding means relative to the winding surface. This complex machinery is avoided with apparatus as described in the first embodiment in which means is incorporated to apply a force at an angle to the direction of traverse and inwardly towards the reel axis as has been described.

As will now be shown by the second embodiment, other forms of apparatus may be designed while still lying within the scope of the present invention.

Figure 9:
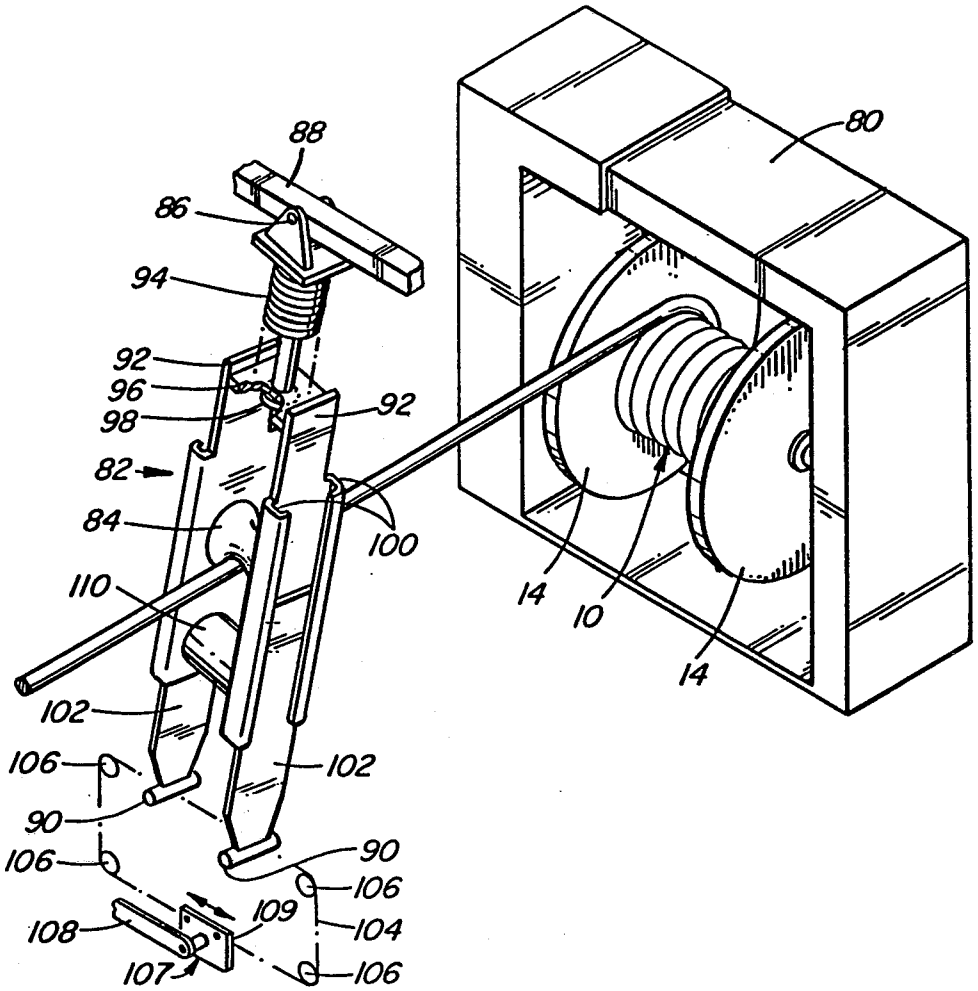
FIG. 9 is an isometric view, partly diagrammatic, of apparatus according to a second embodiment showing it in one position.

In a second embodiment as shown in FIG. 9, a cable reeling apparatus comprises a cable reel 10 in a reel mounting position upon a conventional reel mounting device 80. This particular embodiment incorporates a cable guide mechanism 82 which, because of its design, may not be located between the guide flanges 14 of the reel as described in the first embodiment. The guide mechanism of this embodiment comprises a support which rotatably carries the guide roller 84. As shown by FIG. 9, the support is pivotally supported at its upper end 86 to a cross member 88 and extends across the feed path to be pivotally supported at its lower end 90 as will now be described. The support comprises two spaced-apart and confronting plates 92 having biasing means in the form of a compression spring 94 which urge the two plates together upon cross member 96 away from the top pivotal position 88 until the cross member 96 engages a stop 98 as shown. The compression spring 94 thereby provides the means for applying a force directly through the roller 84 at an angle to the feed path, i.e. it has a component towards the axis of a reel and also in a direction opposite to the relative direction of traverse of the roller 84 and the reel 10. Each plate 92 has side guide flanges 100 which slidably receive a movable plate 102, the lower end of which is pivotally connected to a moving means provided to change the tilt of the support and the roller 84 between a position in which the roller is inclined in one sense relative to the vertical and then in the opposite sense. The moving means comprises an endless driving member 104, shown diagrammatically in FIG. 9, the driving member possibly being a driving belt or chain movable around sprockets or pulleys 106. A drive mechanism 107 is provided for moving the endless drive member 104 one way or the other, as shown by the arrows at the bottom of FIG. 9, sufficiently to cause the angle of the roller 84 to change from one side to the other of the vertical. As shown, the driving means comprises a reciprocal shaft 108 which is connected by a driving plate 109 to the lower flight of the endless drive member.

Upon operation of the apparatus with the guide roller 84 inclined in the direction shown by FIG. 9, the reel 10 is progressing on its traverse towards the left so that winding of cable 12 are laid from left to right. With this particular apparatus a counting mechanism (not shown) counts the revolutions of the reel for each traverse and these revolutions correspond to the amount of windings upon each layer sufficient to fill the reel from one end to the other. Upon the rotations of the reel reaching the predetermined amount, an automatic switch operates to change the direction of traverse of the reel and also to operate the driving means 107 by means (not shown) to move the endless drive 104 in the appropriate direction whereby the support 82 is pivotally moved about end 88 in such a way that its angle of inclination to the vertical is in the opposite direction to that shown by FIG. 9. In this position, the guide roller 84 is inclined in the opposite direction for the next succeeding traverse of the drum to lay the overlaying layer of windings.

As may be seen from the second embodiment, a force is applied to the cable through the guide roller 84 in a fashion different from that employed in the first embodiment, but nevertheless the force acts in a similar direction to that described in a first embodiment to lay cable with its windings closely contacting one another.

The second embodiment also includes a vibrator 110 which is disposed between the plates 92, towards their lower end. This is for the purpose of providing substantially small and rapid vibrations in the support 82 to overcome any tendency for cable, as it is being wound onto the reel, to stick upon contact with a preceding winding whereby the guide roller 84 may locate the cable correctly in position upon the reel.

Figure 10:
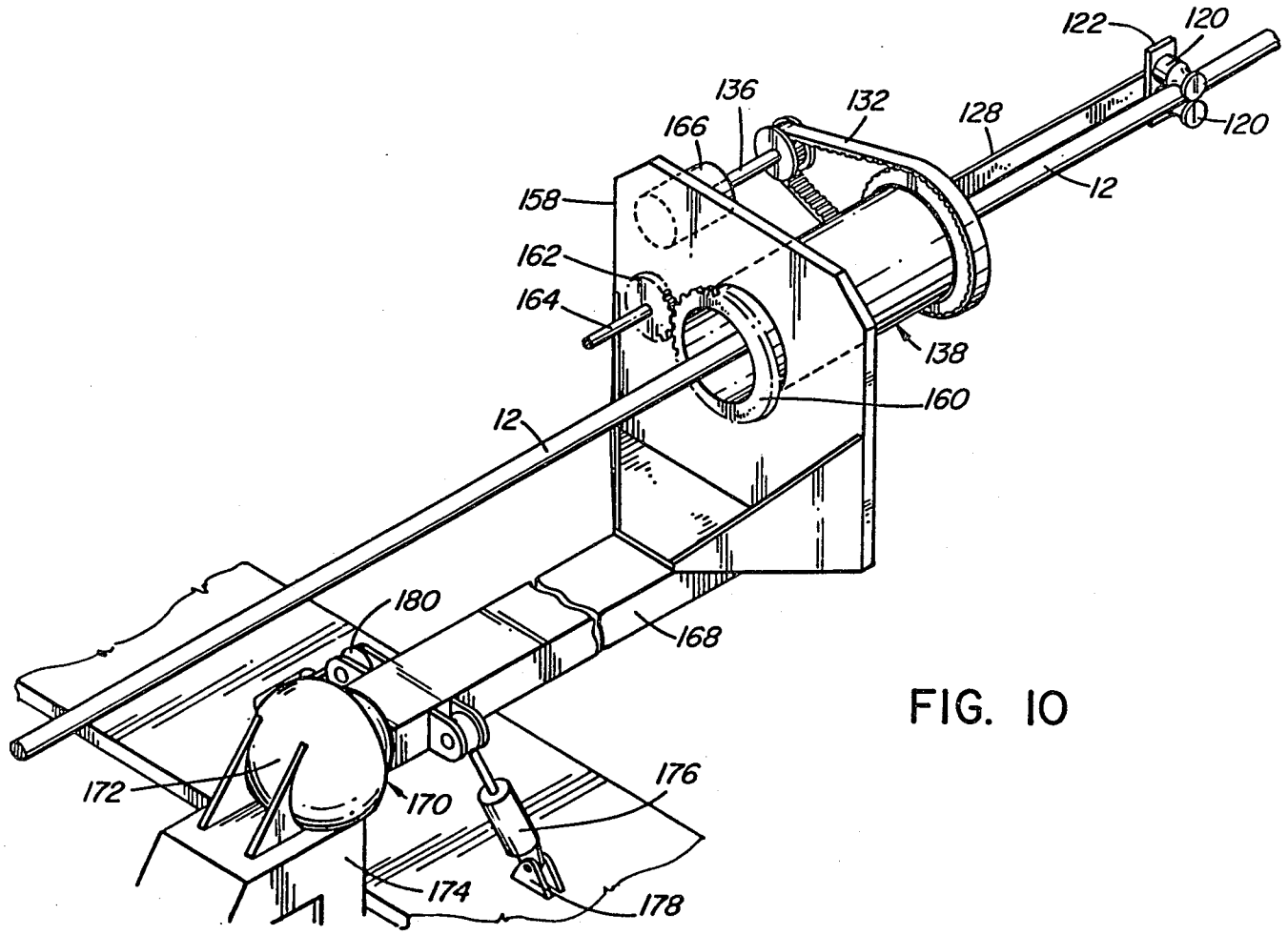
FIG. 10 is an isometric view of cable guide mechanism forming part of apparatus according to a third embodiment.
Figures 11, 12, 13, 14:
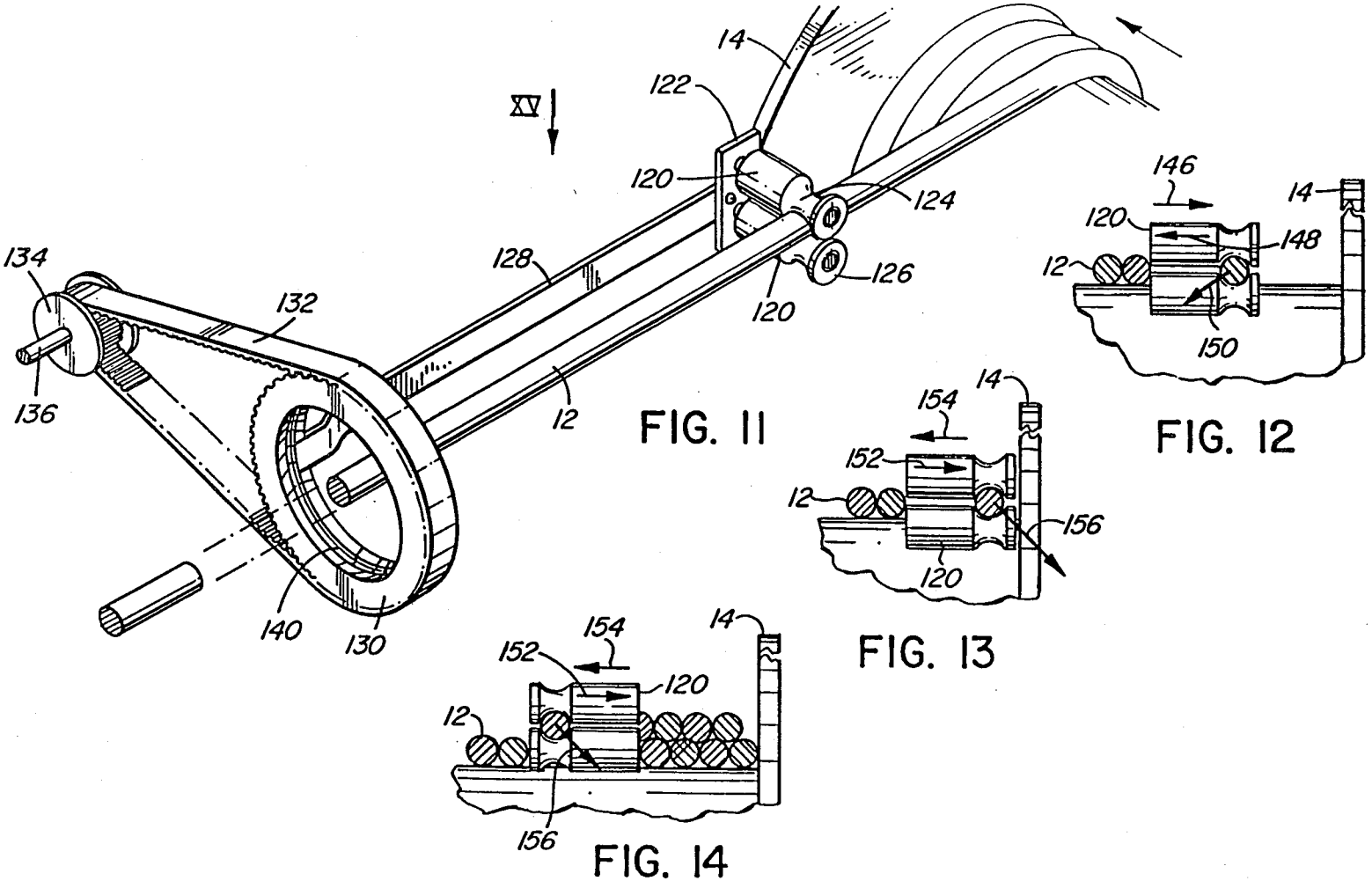
FIG. 11 is an isometric view of part of the mechanism of FIG. 10, on a larger scale, and showing part of a reel
FIGS. 12, 13, and 14 are views showing diagrammatically, change in the operation of the apparatus of the third embodiment from one stage to another.

In a third embodiment, as shown in FIGS. 10 to 17, a cable reeling apparatus comprises a conventional reel mounting device (not shown) and a conventional traversing means to move a reel 10 axially on its traverse as discussed in the previous embodiments. A cable guide mechanism is shown in FIGS. 10 and 11. This guide mechanism comprises a pair of guide rollers 120 which are rotatably mounted each by one end to a plate 122. A cable receiving guide groove 124 in each roller is positioned adjacent to the end 126 of the roller remote from the plate 122, whereby the groove 124 may be located together with its cable closely adjacent to the flange 14 of the reel toward the end of each traverse as will be described.

The plate 122 is mounted at the free end of an arm 128 which extends parallel with the feed path from one side of a metal ring 130 which is rotable around 360° although for present purposes 180° will suffice. A drive means is provided to rotate the ring 130 between limiting positions 180° apart. This drive means comprises an endless drive member in the form of an internally toothed rubber belt 132 which extends around the outside of the ring, in mesh with complementary teeth on the ring and also around a drive pulley 134 with similar teeth, the pulley being mounted upon a drive shaft 136.

A force applying means is provided to apply force through the guide roller means and through the feed path to urge cable as it is wound upon the reel, both inwardly of the reel and against a previous winding. The force applying means comprises a means provided to bias the roller 120 in a trailing sense with regard to the relative direction of traverse of the rollers relative to the reel. It also includes means to pull the rollers inwardly towards the reel axis as will be later described.

Figure 16:
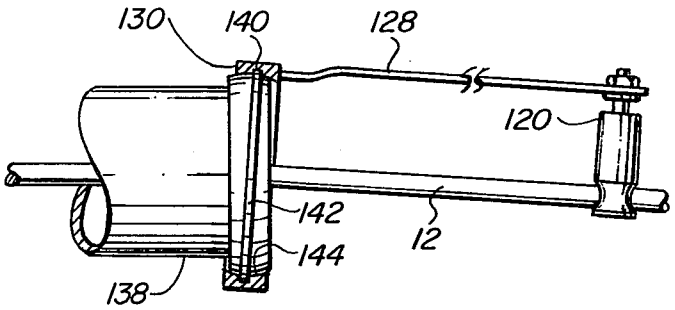
FIG. 16 is a view similar to FIG. 15 of relative positions of parts of the apparatus for the operational conditions shown by FIG. 13.
Figure 15:
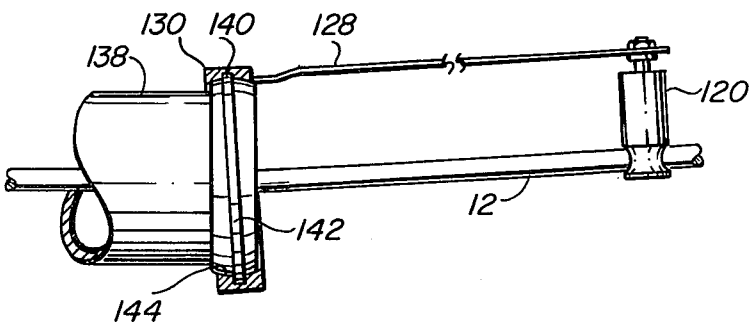
FIG. 15 is a view in direction of arrows XV in FIG. 11, partly in cross-section and showing parts of the apparatus for the operational conditions shown by FIG. 12.
Figure 17:
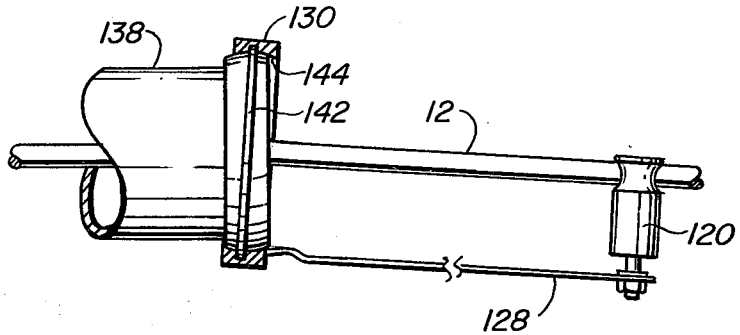
FIG. 17 is a view similar to FIG. 15 of relative positions of parts of the apparatus for operational conditions shown by FIG. 14.

The biasing means comprises an annular drive member 138 shown in FIGS. 10, 15 and 16. This drive member which is not shown in FIG. 11 for clarity, has one end which lies within the ring 130 and is engaged with the ring by means of an inclined annular groove 140 in the ring 130 and an annular rib 142 engaged within the groove 140. The angle of inclination of the groove and rib is exaggerated as shown in FIGS. 15 and 16, but defines an angle less than normal to the axial direction of the annular drive member 138 whereby rotation of the ring member causes the rollers 120 to be displaced slightly one side or the other of the feed path, as viewed in FIGS. 15 and 16, sufficiently to impose a drag upon the cable passing therethrough and onto the reel. Clearly, rotation of the drive member 138 and pivoting of the ring 130 is required for the ring, the arm 128, and thus the rollers to assume their new positions of inclination between FIGS. 15 and 17. Hence it is necessary for the engaging surfaces on each side of the rib 142 and ring 140 to be formed on the surface of a sphere, as shown by surfaces 144, to enable the universal action between the ring 130 and drive member 138 to take place.

The parts of the cable guide mechanism of the third embodiment already described, is mounted upon a vertical carrier plate 158 shown in chain-dotted outline in FIG. 10. As shown somewhat diagrammatically, the drive member 138 is rotatably held at its end remote from ring 130, through the plate 158. The drive member 138 is drivable by means of a surrounding annular gear 160, in mesh with a driving gear 162, drivable through shaft 164 by an electric motor (not shown).

The drive shaft 136 for rotating ring 130, is itself driven by an electric motor 166 mounted upon plate 158.

The plate 158 is welded at one end of a steel beam 168 which is pivotally carried in universal manner by a universal pivotal connection 170, at its other end. The housing 172 of the connection is secured to a main frame 174 of the apparatus as shown.

The means to pull the rollers inwardly towards the reel axis referred to above, may comprise one, but actually comprises two piston and cylinder assemblies 176 which are pivotally connected, one to each side of beam 168, towards the connection 170, and are connected also to the main frame at 178. In FIG. 10, one assembly 176 is shown clearly. The other is mainly hidden, but can be seen by its piston rod 180.

The two assemblies 176 are inclined to the vertical as shown. Operation of these assemblies is dependent upon the position of the rollers 120 during laying of cable, and are caused to act together to urge the beam 168 downwardly about bearing 170, with one assembly 176 acting more positively than the other to incline the direction of downward force alternately in one sideways direction or the other.

In use of the apparatus of the third embodiment, as the cable is being wound into convolutions upon the reel, as shown by FIG. 11, the reel is moving from right to left, i.e. in the direction of the arrow above the windings as shown in that Figure. Thus, as shown by FIG. 12, the relative direction of traverse of the guide rollers 120 is in the direction of arrow 146 in that Figure. When the direction of traverse is as shown by FIG. 12, the position of the annular drive member 138 is as shown by FIG. 15. With the rib and groove inclined towards the right, the rollers 120 are tilted towards the left whereby a force upon the cable passing through the rollers is in the direction 148, shown by FIG. 11, i.e. the direction opposite to the direction of traverse. Also, the two piston and cylinder assemblies 176 are operated together to apply a downward force on beam 168 with a component of the force acting downwardly towards the left as viewed in FIG. 12. The net effect of the downward force and of the force in direction 148 is to produce a force which is inclined at a direction shown by the arrow 150 in FIG. 12. This force acting upon the cable, holds the cable towards the previous convolution and also towards the winding surface as cable is being laid whereby it cannot be spaced from the previous winding and also cannot ride over the previous winding during the reeling procedure.

When the traverse in the direction of arrow 146 is complete, the position of the reel actuates the drive motor for the drive member 138 whereby the drive member rotates to the position shown in FIG. 16 and tilts the ring 130 in the opposite direction. Hence the force 148 in FIG. 12 is replaced by a force in the opposite direction 152, as shown by FIG. 13, during the final winding. As may be seen from FIG. 13, the final winding locates the cable closely adjacent to the reel flange 14 by virtue of the location of the grooves 124 in the rollers adjacent to their ends 126. The position of the reel on its traverse also causes the operation of a means for reversing the traverse so that it is then caused to traverse in the direction 154 shown by FIG. 13. Simultaneously with this, the piston and cylinder assemblies 176 are operated to alter their relative pulls to cause their downward force to have a bias towards the right as viewed in FIG. 13. The combined effect of this with the force 152 is to produce a downward force in the direction of arrow 156 in FIG. 13.

After the traverse has proceeded sufficiently far to enable the rollers 120 to be reversed in direction without fouling against the flange 14, a signal, again from the position of the reel, is transmitted to the motor 166 for the drive shaft 136. Rotation of the drive belt 132 turns the ring 130 and thus the guide roller 120 around 180° so that they are facing in the direction of FIGS. 14 and 17. In this position and during continued movement of the reel to give the direction of traverse as shown by arrow 154, the force applied by the inclination of ring 130 is still in the direction 152, because the position of the annular drive member 138 was not changed during the rotational movement of the guide rollers 120 (compare FIGS. 16 and 17).

The cable is then wound upon the reel in the direction 154. Upon reaching the other flange 14, a change in direction of force back to the direction 148 takes place before the change in direction of traverse, and the assemblies 156 have their combined force adjusted to bias the downward force towards the left. This procedure is opposite to but similar to that described above with regard to FIGS. 12 and 13. After the next traverse has proceeded for a short period, the rolls are again reversed by movement of the drive member 138 to return them to their positions shown by FIG. 12. The third embodiment, although being of an entirely different construction from that disclosed with regard to the first and second embodiments, provides a force operating in the same direction, i.e. the force in the direction of arrow 150 in FIG. 12 and a correspondingly inclined force 156 in the other direction in FIGS. 13 and 14.

What is claimed is:

1. A cable laying apparatus comprising a mounting for a reel in a reel mounting position; means to rotate the mounted reel about its axis; a cable guide mechanism incorporating guide roller means carried upon a support on one side of a pass line for cable as it is wound onto the reel, and a traversing means to relatively traverse the guide roller means and the reel mounting in one direction to provide one layer of windings and then in the opposite direction to provide a succeeding layer of windings; force applying means to apply a force through the guide roller means and through the feed-path at an angle to both the direction of relative traverse and to a plane normal to the reel axis, said force having a first component opposite to the direction of relative traverse of the guide roller means and a second component inwardly towards said reel axis so as to urge cable as it is wound onto the reel both inwardly of the reel against windings of a previous layer and axially against the previous winding of the layer being formed; and means operable at the end of each traverse to change the direction of traverse and the direction of said force relative to said plane by changing the first component of the force to correspond to the change in the direction of traverse.

2. Apparatus according to claim 1, wherein the guide roller means comprises a cable laying guide roller which is inclined to the direction of traverse of the roller with part of the roller facing the feed path being a trailing part with regard to the relative direction of traverse, and means are provided, operable at the end of traverse in each direction, to change the angle of inclination of the guide roller to one opposite to the relative direction of traverse of the guide roller in said opposite direction.

3. Apparatus according to claim 2, wherein the guide roller is mounted on an arm extending along the direction of the feed path, the arm being oscillatable and the means to change the angle of inclination of the guide roller comprising a position control device operably connected to the oscillatable arm to oscillate the arm between one angular position and another corresponding to the two angles of inclination of the guide roller.

4. Apparatus according to claim 3, wherein the position control device comprises a fluid operated cylinder, operation of which moves the oscillatable arm between one angular position and the other.

5. Apparatus according to claim 3, wherein the means to change the angle of inclination of the roller comprises switch means disposed upon the oscillatable arm and intended to be disposed between end flanges of a reel during relative traverse of the reel and guide roller, the switch means electrically connected to actuate the position control device and operable to actuate the device upon movement of the switch means into proximity with each reel flange.

6. Apparatus according to claim 5, wherein the switch means is an optical sensing device.

7. Apparatus according to claim 4, wherein the oscillatable arm is an extension of a non-oscillatable arm and the cylinder is operably connected between the two arms.

8. Apparatus according to claim 7, wherein the non-oscillatable arm is pivotally mounted to a frame and a positioning cylinder is connected between the frame and the non-oscillatable arm to move the arm about its pivotal connection and provide the force applying means.

9. Apparatus according to claim 3, provided with a vibrator for vibrating the oscillatable arm and the guide roller to overcome any tendency for cable to be prevented from being laid in its correct winding position as it is reeled onto the drum and by frictional contact with a previous winding.

10. Apparatus according to claim 2, wherein the guide roller means incorporates a second guide roller spaced upstream along the feed path from the cable laying guide roller in a position to apply an opposite force to the cable from that provided by the cable laying guide roller so as to hold the cable away from a previous winding as it is fed towards the reel, the cable laying guide roller thereby operating to move the cable into contact with a previous winding as it is being laid in position.

11. Apparatus according to claim 2, wherein the guide roller is mounted upon a support extending radially from the feed path, the support being adjustable around the feed path to change the angle of inclination of the guide roller.

12. Apparatus according to claim 11, wherein the support extends across the feed path and is pivotally supported at spaced positions at each side of the feed path, one of said spaced positions being connected to a moving means operable to tilt the support and roller between oppositely inclined positions, part of the support being biased to urge the roller against the cable and apply said force at the angle of inclination of the roller.

13. Apparatus according to claim 11, wherein the moving means comprises an endless drive member and said support is pivotally connected to the endless drive member, movement of the drive member in the appropriate direction causing the support to be pivoted about its other end so as to tilt the support and roller between the opposing inclined positions.

14. Apparatus according to claim 1, wherein the guide roller means comprises two guide rollers opposed to one another across the feed path, the rollers mounted upon an arm to closely hold the cable as it is fed through the rollers and onto the reel, and the force applying means comprises a biasing means provided for biasing the rollers in a trailing sense during each traverse whereby the rollers pull the cable directly against a previous winding upon the reel.

15. Apparatus according to claim 14, wherein the rollers are mounted on an arm extending axially of the feed path, the arm being rotatable through at least an angle of 180° to dispose the rollers facing in one direction during traverse of the guide rollers and reel mounting in one relative direction and to dispose the rollers facing in the opposite direction upon traverse in the opposite direction.

16. Apparatus according to claim 15, wherein each guide roller has a guide groove which is adjacent to an end of the roller which lies in the forward direction when considering the relative direction of movement of traverse.

17. Apparatus according to claim 16, wherein the arm is mounted on a ring surrounding the feed path and drive means is provided for rotating the ring around the feed path for an angle of at least 180°.

18. Apparatus according to claim 17, wherein the drive means is an endless drive member drivably connecting the drive ring to the drive shaft.

19. Apparatus according to claim 18, wherein the endless drive member is an internally toothed belt in mesh with complementary teeth on the ring and on the driving shaft.

20. Apparatus according to claim 17, wherein the biasing means is an annular drive member engaging the ring by means of an inclined annular groove and an inclined annular ring which are interengaged, rotation of the annular drive member causing the ring to tilt about the annular drive member with regard to the feed path.

21. Apparatus according to claim 14, wherein the two guide rollers are carried upon an apparatus frame by a universal pivotal connection and said force applying means comprises a fluid-operated device to apply a pivotally turning force at said connection.

22. Apparatus according to claim 21 provided with a beam universally pivotally connected to the frame at said connection, and the fluid-operated device comprises at least one piston and cylinder assembly operably associated with the beam to apply a downward force thereto.

23. Apparatus according to claim 22, wherein the fluid-operated device comprises two piston and cylinder assemblies connected one to each side of the beam and inclined in opposite directions relative to the vertical, the assemblies being actuable together to apply a downward force upon the beam in a direction inclined towards the vertical, alternately to one side and then the other of the pass line.

24. Apparatus according to claim 20, wherein the rollers, the arm, the drive means and the biasing means are carried by a carrier plate with the annular drive member rotatable within the plate, and the plate is mounted upon a beam which is connected to an apparatus frame at a universal pivotal connection, and the force applying means also comprises two piston and cylinder assemblies connected one to each side of the beam and inclined in opposite directions relative to the vertical, the assemblies being actuable together to apply a downward force upon the beam in a direction inclined towards the vertical, alternately to one side and then the other of the pass line.

25. A cable laying apparatus comprising:

a mounting for a reel in a reel mounting position; means to rotate the mounted reel about its axis; a cable guide mechanism incorporating a guide roller means and a traversing means to relatively traverse the guide roller means and the reel mounting in one direction to provide one layer of windings and then in the opposite direction to provide a succeeding layer of windings; the guide roller means comprising a cable laying guide roller and a second guide roller both carried upon a support disposed on one side of a feedpath for cable as it is wound onto the reel and in which:

the laying roller has an axis which is held inclined to the direction of traverse of the roller and to a plane normal to the reel axis during operation of the traversing means and with part of the laying roller which faces the feedpath being a trailing part with regard to the direction of traverse; force applying means to apply a force through the laying roller and through the feedpath at an angle to both the direction of relative traverse and to a plane normal to the reel axis, said force having a first component opposite to the direction of relative traverse of the guide roller means and a second component inwardly towards the reel axis so as to urge cable as it is wound onto the reel both inwardly of the reel against windings of a previous layer and axially against the previous winding of the layer being formed; and means operable at the end of each traverse to change the direction of traverse and the direction of said force relative to said plane by changing the first component of the force to correspond to the change in the direction of traverse; said second guide roller spaced upstream along the feedpath from the laying roller in a position to apply an opposite force to the cable from that provided by the laying roller so as to hold the cable away from the previous winding as it is fed towards the reel, the laying roller thereby operating to move the cable at an angle to the previous winding and into contact with the previous winding.

* * * * *